US006276251B1

(12) United States Patent
Downing et al.

(10) Patent No.: US 6,276,251 B1
(45) Date of Patent: Aug. 21, 2001

(54) MUZZLE BRAKE

(75) Inventors: Dirk Johannes Downing; Tielman Niewoudt, both of Pretoria (ZA)

(73) Assignee: Denel Limited, Pretoria (ZA)

( * ) Notice: Subject to any disclaimer, the term of this patent is extended or adjusted under 35 U.S.C. 154(b) by 0 days.

(21) Appl. No.: 09/271,258

(22) Filed: Mar. 17, 1999

(30) Foreign Application Priority Data

Mar. 20, 1998 (ZA) ..... 98/2392

(51) Int. Cl.[7] ..... F41A 21/38
(52) U.S. Cl. ..... 89/14.3
(58) Field of Search ..... 89/14.3

(56) References Cited

U.S. PATENT DOCUMENTS 2,372,315 * 3/1945 Catron ..... 89/14.3
5,123,329 * 6/1992 Irwin ..... 89/14.3

FOREIGN PATENT DOCUMENTS 100272 12/1898 (DE) .
633568 * 1/1928 (FR) ..... 89/14.3
1474832 * 2/1967 (FR) ..... 89/14.3
233709 * 1/1926 (GB) ..... 89/14.3
2294106 2/1997 (GB) .

* cited by examiner

*Primary Examiner*—Stephen M. Johnson
(74) *Attorney, Agent, or Firm*—Dorsey & Whitney LLP

(57) ABSTRACT

A muzzle brake for a gun which comprises an annular member mountable on the firing end of the muzzle of the gun, which member comprises a pair of concentrically located annular elements of which the first one is mounted stationary relative to the muzzle of the gun and the second one is slidably movable against the biasing action of a spring relative to said first element in a direction opposite the firing direction of the gun, said movement taking place under the influence of the exhaust gas resulting from the firing of a projectile by the gun, and said movement being from a first extreme position into which said spring forces said second element, in which position the brake is in the 'off' position, to a second extreme position where the brake is in the fully 'on' position, in which position said exhaust gas can force the first element, and hence the muzzle of the gun, to move in the firing direction, and so counteract the recoil action of the gun.

37 Claims, 3 Drawing Sheets

MUZZLE BRAKE

BACKGROUND AND PRIOR ART

This invention relates to a muzzle brake for reducing the recoil action resulting from the firing of a gun.

Muzzle brakes which serve to reduce the recoil action of a gun when it is fired, operate on the principle that they utilise the forward momentum of the pressure wave produced by the expanding exhaust gas which follows the projectile on firing of the gun, by deflecting some of such exhaust gas in a suitable manner to produce a forward impulse on the brake and hence the barrel of the gun, in this way at least balancing to some degree the recoil impulse on the barrel of the gun.

Most muzzle brakes are characterised by the fact that they comprise static components such as baffle plates and apertures so that the braking action effected by them is rather abrupt and hence capable of interfering with the smooth recoil action and balance of the gun. Furthermore, they often also give rise to very high overpressure levels which may be detrimental to the comfort and well being of the crew operating the gun.

Although it has been known in the past to employ muzzle brakes with movable components, the arrangements which have hitherto been suggested have not been very successful, usually because of mechanical failure.

OBJECT OF THE INVENTION

It is an object of this invention to provide a muzzle brake, particularly one for artillery pieces such as canons and the like, which the applicant believes has advantages over the known arrangements.

SUMMARY OF THE INVENTION

According to the invention a muzzle brake for a gun is provided which comprises an annular member mountable on the firing end of the muzzle of the gun, which member comprises a pair of elements of which the first one is mounted stationary relative to the muzzle of the gun and the second one is slidably movable against the biasing action of a means relative to said first element in a direction opposite the firing direction of the gun, said movement taking place under the influence of the exhaust gas resulting from the firing of a projectile by the gun, and said movement being from a first extreme position into which said biasing means forces said second element, in which position the brake is in the 'off position', to a second extreme position where the brake is in the fully 'on' position, and where said exhaust gas can force the first element, and hence the muzzle of the gun, to move in the firing direction, and so counteract the recoil action of the gun.

Further according to the invention the two elements are annular and are located concentrically relative to each other, the said first each element having at least one aperture extending through its wall, which aperture(s) being so located relative to the aperture(s) on the said second element that when the said second element is in its said first extreme position, the apertures are completely out of register with each other, and the brake is in the 'off' position, and when the said second element is in its said second extreme position, the apertures register fully with each other, and the brake is in the 'on' position.

It will be appreciated that while said second element is moving under the influence of said exhaust gas relative to said first element, the said apertures in the elements will move progressively into register with each other and the action which the gas has on said first element will accordingly be applied progressively, and not as abruptly as what the case is with the hitherto suggested arrangements.

Further according to the invention each element has at least two apertures which are located in diametrically opposed relationship relative to one another.

Further according to the invention the mouth of each of the apertures of the said second element is shielded by a substantially L-shaped flange which extends into the bore of the second element, with the shorter leg of the 'L' pointing in the firing direction, so that exhaust gas passing through the bore of the second element can only pass into the aperture(s) of the second element in a direction opposite that of the firing direction of the gun and hence exert a force on the second element to cause it to slide in a direction opposite the firing direction of the gun.

Still further according to the invention each of the apertures in the said first element is provided with a wing or the like which extends at an angle to the outside of the element in a direction away from the firing end of the gun of the first element, said angle being such that exhaust gas passing through such aperture in the first element will exert a force on such wing causing the first element, and hence the muzzle of the gun, to move in the firing direction, and hence counteract the recoil action of the gun.

Still further according to the invention each element has two sets of axially spaced apertures, each set comprising at least two diametrically opposed arcuately shaped slots which extend through the material of the element.

Preferably each of such slots extends over an angle in the order of 110° along the circumference of the element.

Still further according to the invention the said biasing action on the second element is effected by a plurality of springs which are spaced circumferentially about said second element.

Still further according to the invention the rotational position of said second element relative to said first element is adjustable so that the degree of registration of said apertures when said second element is slidably moved relative to said first element, is adjustable.

Still further according to the invention said first extreme position of the second element is defined by an annular shoulder provided in the bore of the first element at that end of it furthest away from the muzzle of the gun.

Preferably such shoulder is defined by the rim of an annular cap which fits into the mouth of the first element at its said end.

Still further according to the invention said second extreme position of the second element is defined by another annular shoulder provided in the bore of the first element in a position spaced from said first annular shoulder.

Further according to the invention the springs may be pretentioned by inserting one or more spacer elements between the end of a spring and an annular step formation provided in the bore of the first element.

It will be appreciated that the biasing action exerted by the springs on the inner sleeve may also be adjusted by removing or adding springs.

In a presently preferred embodiment of the invention said first and second elements may comprise a pair of concentrically located metal sleeves, of which said second element comprises the inner sleeve, and said first element the outer sleeve.

DETAILS OF THE DRAWINGS

DESCRIPTION OF THE INVENTION

Figure 1:
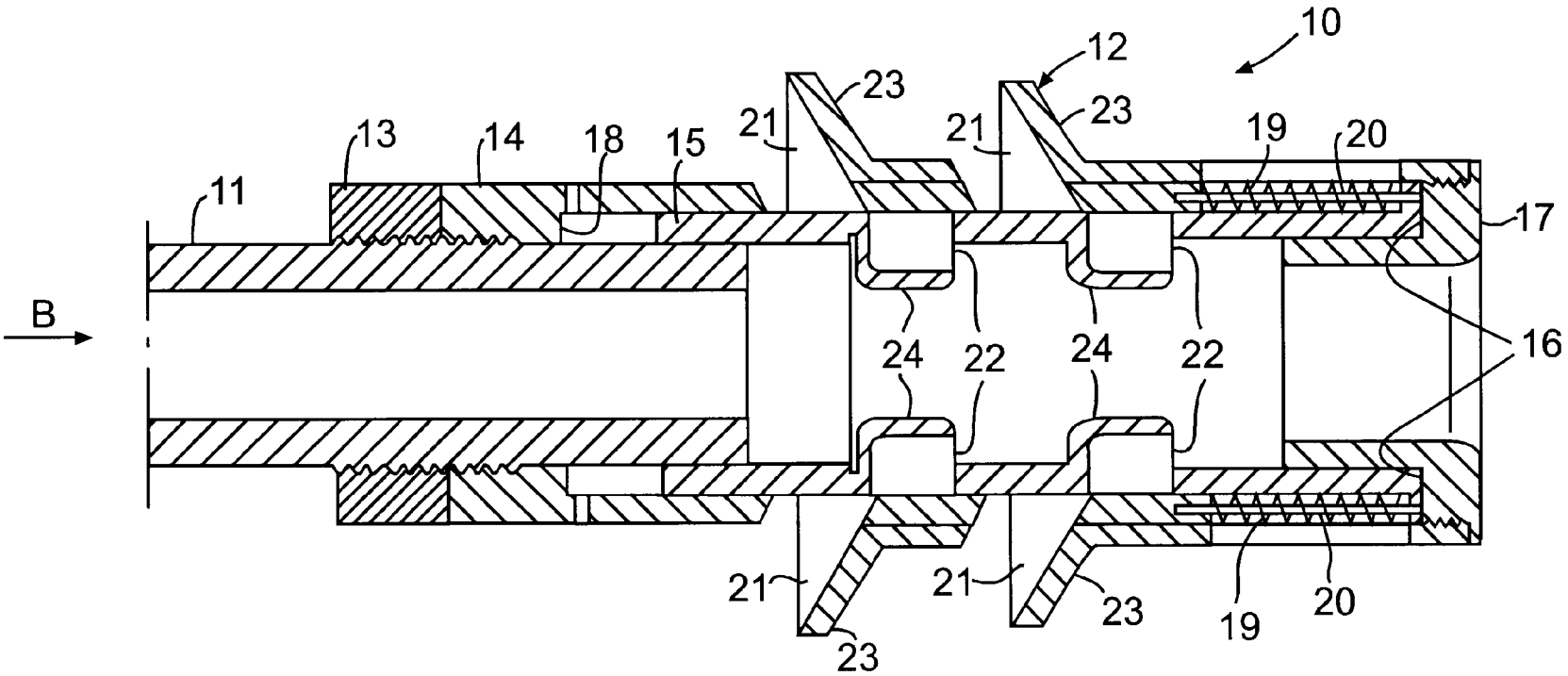
FIG. 1 is a diagrammatic longitudinal cross sectional view on the line A: A in FIG. 3 of a muzzle brake according to the invention fitted to the muzzle of a gun, the brake being shown in the 'off' position.

One embodiment of the invention will now be described by way of example with reference to the enclosed drawings.

In this embodiment of the invention a muzzle brake 10 is shown as fitted to the barrel 11 of a gun such as an artillery piece of the like (not shown). Brake 10 comprises an annular steel member 12 which is screwed onto the firing end of barrel 11, and secured thereto by means of a lock nut 13.

Member 12 comprises an outer annular element or sleeve 14, in the bore of which an inner annular element or sleeve 15 is telescopically movable between a first extreme position, defined by an annular shoulder formation 16 provided by the underside of the rim of an annular end cap 17 which fits into the mouth of the bore of sleeve 14 so that cap 17 is located stationary relative to barrel 11, and a second extreme position defined by another annular shoulder formation 18 provided in the bore of sleeve 14 in a position spaced from said shoulder formation 16.

The free end of sleeve 15 furthest away from the end of barrel 11 is connected to the one set of ends of a plurality of coiled springs 19 which are located circumferentially about the outer end of sleeve 15 in an annular space defined in the outer end of sleeve 15. Sliding movement of sleeve 15 in the direction opposite to that of arrow 'B', i.e. opposite the firing direction of the gun, takes place against the biasing action of springs 19. The biasing action of springs 19 accordingly serve to force sleeve 15 into its first extreme position shown in FIG. 1, i.e. in which the said free end of sleeve 15 engages shoulder formation 16 on cap 17, and brake 10 is in the 'off' position.

Each spring 19 is mounted about an elongated pin 20 of which the inner end is secured to an annular step formation in the outer end of sleeve 14, the outer end of such pin 20 passing slidably through an aperture provided in the end rim of said annular space in sleeve 15 to allow for its aforesaid sliding movement.

Each of sleeves 14 and 15 is provided with two sets of axially spaced diametrically opposed slots 21 and 22 respectively which extend through the walls of the sleeves.

Figure 3:
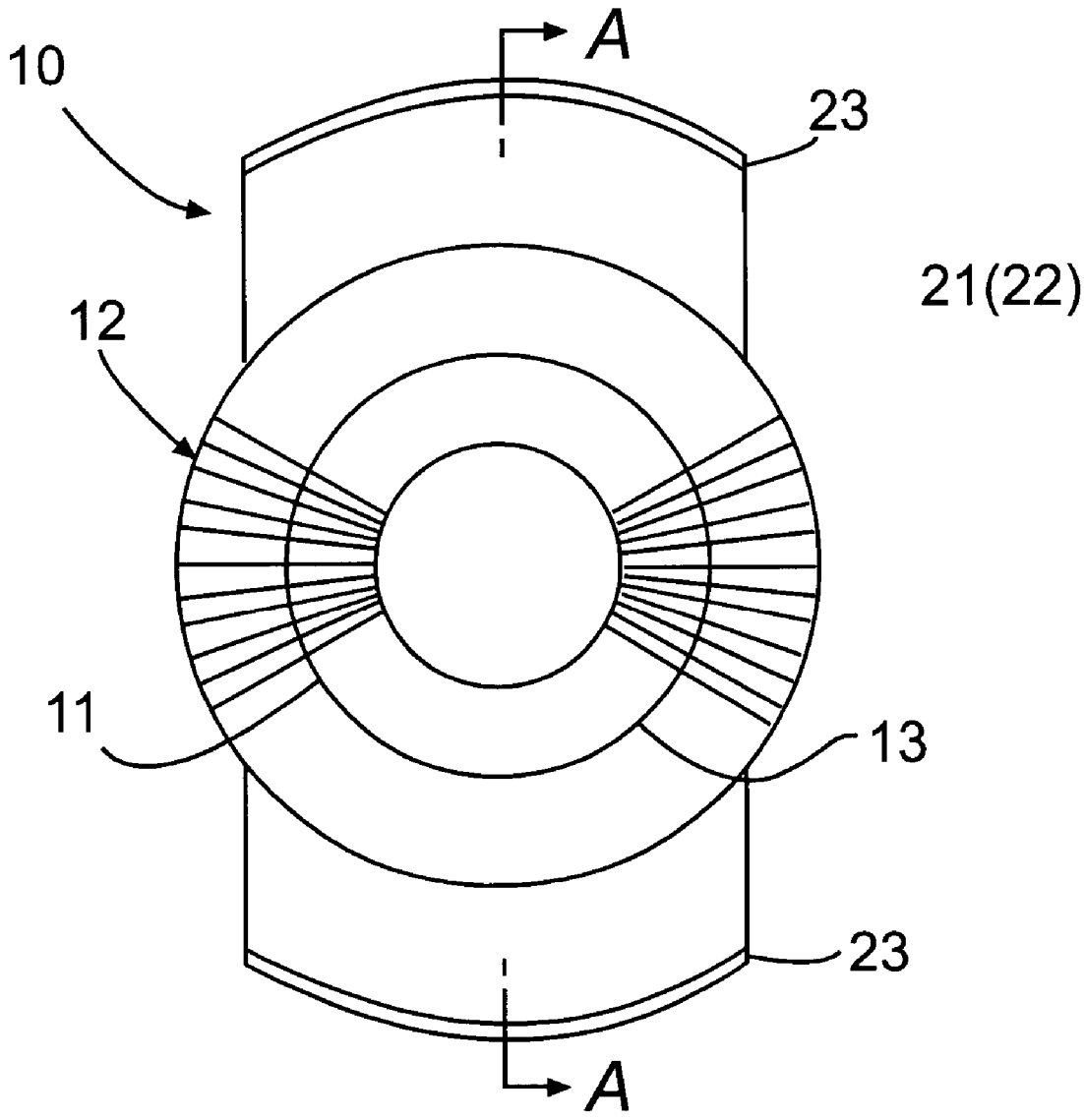
FIG. 3 is an end on view, partly in section of the apparatus of FIGS. 1 and 2 as seen in the direction of arrow 'B' in FIGS. 1 and 2.

As can be seen from FIG. 3, each set of slots 21 and 22 extends over an angle in the order of 110° through the walls of sleeves 14 and 15 respectively.

Figure 2:
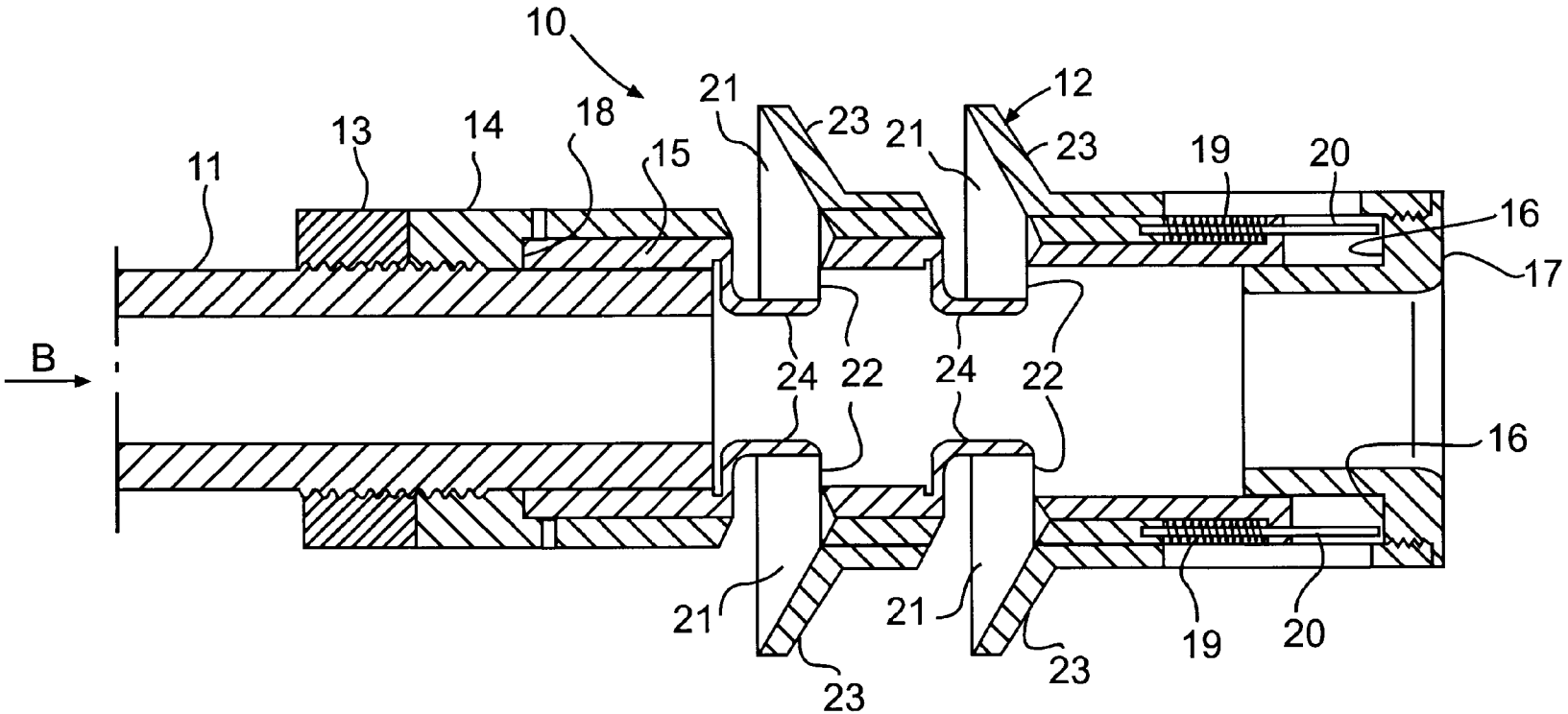
FIG. 2 is a similar view as that of FIG. 2, but with the brake being shown in the 'on' position.

As can be seen from FIGS. 1 and 2, slots 21 and 22 are so located relative to one another that when sleeve 15 is in its said first extreme position where springs 19 force it flush up against shoulder formation 16 defined by end cap 17, slots 21 and 22 are off set relative to one another and hence completely out of register with one another.

As will be explained later, brake 10 operates on the basis that sleeve 15 can be moved slidably under the influence of the exhaust gases passing from barrel 11 through the bore of brake 10, against the action of springs 19, to a second extreme position where the inner end of sleeve 15 engages shoulder formation 18 in the bore of sleeve 14, in which extreme position corresponding slots 21 and 22 of sleeve 14 and 15 fully register with one another.

Each of the slots 21 is provided with an arcuately shaped wing 23 which is integral with sleeve 14 and which slopes outwardly in a direction opposite that of arrow 'B', the configuration of wings 23 being such that they present baffles for gas escaping from slots 21, which gas accordingly forces sleeve 15, and hence barrel 11, in the firing direction, i.e. in the direction of arrow 'B', thus counteracting the recoil action of the gun.

Each of slots 22 is provided with a substantially L- shaped arcuate lip formation 24, which extends into the bore of sleeve 15, with the shorter leg of the 'L' pointing in the same direction as arrow 'B', so that gas from inside the bore of sleeve 15 can only pass into the mouth of a slot 22 in the direction opposite the firing direction, i.e. opposite the direction indicated by arrow 'B'. Such gas will accordingly force sleeve 15 to move slidably relative to sleeve 14 against the biasing action of springs 19 in the direction opposite to that indicated by arrow 'B' until the inner end of sleeve 15 engages shoulder formation 18 in sleeve 14, as is indicated in FIG. 2.

In this position corresponding slots of sets 21 and 22 will be in full register with one another thus giving rise to the full braking action referred to above, and brake 10 is hence in the 'on' position, where it serves fully to counter the recoil action of the gun.

As the slots 21 and 22 will during the aforesaid sliding movement move progressively into said overlapping relationship with one another, the braking action caused on barrel 11 will be applied progressively during such movement, and hence not as abruptly as what the case is with the hitherto known arrangements.

Apart from giving rise to a smoother braking action which contributes to a smoother recoil action and improved balance for the gun, the components of the brake are also far less capable of mechanical break down than what the case is with the aforesaid known arrangements. Furthermore, the overpressure resulting from such escaping gas will accordingly also be spread over a period of time, thus causing less of a discomfort to the crew operating the gun than what the case is with the conventional type of arrangement.

It will be appreciated that there are no doubt many variations in detail possible with a muzzle brake according to the invention without departing from the spirit and/or scope of this disclosure.

Thus, for example, in one embodiment of the invention the stationary annular sleeve may be located in the bore of the sliding sleeve. Also, by rotating sleeves 14 and 15 relative to one another, and securing them in a particular angular position relative to one another, slots 21 and 22 may be offset relative to one another in the radial direction, which will accordingly effect their overlapping and hence the resulting braking action of the apparatus. Furthermore, it may be possible to use the barrel 11 of the gun itself as the stationary sleeve 14 and to mount the sleeve 15 slidably movable relatively thereto. However, because the barrel of a gun usually has a much longer useful life than the components of the muzzle brake itself, this may well prove not to be as successful an arrangement as that described above.

What is claimed is:

1. A muzzle brake in combination with a gun comprising:

an annular member mountable on a firing end of the muzzle of the gun, wherein the annular member comprises a pair of elements, the first element is mounted stationary relative to the muzzle of the gun, and the second element is slidably movable against biasing action of a means relative to said first element in a direction opposite a firing direction of the gun, said movement taking place under the influence of exhaust gas resulting from the firing of a projectile by the gun, said movement being from a first extreme position into which said biasing means forces said second element, in which position the brake is in the 'off' position, to a second extreme position where the brake is in the fully 'on' position, in which position said exhaust gas can force the first element and the muzzle of the gun to move in the firing direction to counteract recoil action of the gun.

2. The muzzle brake of claim 1, wherein the first and second elements are annular and are concentrically located relative to each other, the first element having at least one aperture being so located relative to apertures on the second element, wherein when the second element is in its said first extreme position, the apertures are completely out of register with each other and the brake is in the fully 'off' position, and when the second element is in its said second extreme position, the apertures register fully with each other and the brake is in the fully 'on' position.

3. The muzzle brake of claim 2, wherein the first and second elements have at least two apertures which are located in diametrically opposed relationship relative to one another.

4. The muzzle brake of claim 2, wherein at least one aperture of the first element is provided with a wing which extends at an angle to the outside of the first element, in a direction away from the firing end of the gun, said angle being such that exhaust gas passing through said at least one aperture in the first element will exert a force on the wings, causing the first element and the muzzle of the gun to move in the firing direction, and counteract the recoil action of the gun.

5. The muzzle brake of claim 2, wherein the rotational position of said second element relative to said first element is adjustable so that the degree of registration of said apertures when said second element is slidably moved relative to said first element is adjustable.

6. The muzzle brake of claim 1, wherein the first and second elements have two sets of axially spaced apertures, and wherein the two sets of axially spaced apertures comprises at least two diametrically opposed arcuately shaped slots which extend through the material of the first and second elements.

7. The muzzle brake of claim 6 wherein each of the slots extends over an angle in the order of 110 over the circumference of the first and second elements.

8. The muzzle brake of claim 1 wherein said first extreme position of the second element is defined by an annular shoulder provided in the bore of the first element at that end furthest away from the muzzle of the gun.

9. The muzzle brake of claim 8 wherein said second extreme position of the second element is defined by an annular shoulder provided in the bore of the first element in a position spaced from the annular shoulder provided in the bore of the first element.

10. The muzzle brake of claim 9, wherein said biasing action of a means constitutes springs which are pretentioned by inserting one or more spacer elements between the end of a spring and an annular step formation provided in the bore of the first element.

11. A muzzle brake in combination with a gun comprising:

an annular member mountable on a firing end of the muzzle of the gun, wherein the annular member comprises a pair of elements, the first element is mounted stationary relative to the muzzle of the gun, and the second element is slidably movable against biasing action of a means relative to said first element in a direction opposite a firing direction of the gun, said movement taking place under the influence of exhaust gas resulting from the firing of a projectile by the gun, said movement being from a first extreme position into which said biasing means forces said second element, in which position the brake is in the 'off' position, to a second extreme position where the brake is in the fully 'on' position, in which position said exhaust gas can force the first element and the muzzle of the gun to move in the firing direction to counteract recoil action of the gun, the first and second elements are annular and are concentrically located relative to each other, the first element having at least one aperture being so located relative to apertures on the second element, wherein when the second element is in its said first extreme position, the apertures are completely out of register with each other and the brake is in the fully 'off' position, and when the second element is in its said second extreme position, the apertures register fully with each other and the brake is in the fully 'on' position, wherein a mouth of the apertures of the second element is shielded by a substantially L-shaped flange which extends into the bore of the second element, with the shorter leg of the 'L' pointing in the firing direction so that exhaust gas passes through the bore of the second element in a direction opposite that of the firing direction of the gun and exerts force on the second element to cause it to slide in a direction opposite the firing direction of the gun.

12. The muzzle brake of claim 11, wherein the first and second elements have at least two apertures which are located in diametrically opposed relationship relative to one another.

13. The muzzle brake of claim 11, wherein at least one aperture of the first element is provided with a wing which extends at an angle to the outside of the first element, in a direction away from the firing end of the gun, said angle being such that exhaust gas passing through said at least one aperture in the first element will exert a force on the wing, causing the first element and the muzzle of the gun to move in the firing direction, and counteract the recoil action of the gun.

14. The muzzle brake of claim 11, wherein the first and second elements have two sets of axially spaced apertures, and wherein the two sets of axially spaced apertures comprises at least two diametrically opposed arcuately shaped slots which extend through the material of the first and second elements.

15. The muzzle brake of claim 14 wherein each of the slots extends over an angle in the order of 110 over the circumference of the first and second elements.

16. The muzzle brake of claim 11, wherein the rotational position of said second element relative to said first element is adjustable so that the degree of registration of said apertures when said second element is slidably moved relative to said first element is adjustable.

17. A muzzle brake in combination with a gun comprising:

an annular member mountable on a firing end of the muzzle of the gun, wherein the annular member comprises a pair of elements, the first element is mounted stationary relative to the muzzle of the gun, and the second element is slidably movable against biasing action of a means relative to said first element in a direction opposite a firing direction of the gun, said movement taking place under the influence of exhaust gas resulting from the firing of a projectile by the gun, said movement being from a first extreme position into which said biasing means forces said second element, in which position the brake is in the off position to a second extreme position where the brake is in the fully 'on' position, in which position said exhaust gas can force the first element and the muzzle of the gun to move in the firing direction to counteract recoil action of the gun, wherein the biasing action on the second element is effected by a plurality of springs which are spaced circumferentially about said second element.

18. The muzzle brake of claim 17, wherein the first and second elements are annular and are concentrically located relative to each other, the first element having at least one aperture being so located relative to apertures on the second element, wherein when the second element is in its said first extreme position, the apertures are completely out of register with each other and the brake is in the fully 'off' position, and when the second element is in its said second extreme position, the apertures register fully with each other and the brake is in the fully 'on' position.

19. The muzzle brake of claim 18, wherein the first and second elements have at least two apertures which are located in diametrically opposed relationship relative to one another.

20. The muzzle brake of claim 18, wherein at least one aperture of the first element is provided with a wing which extends at an angle to the outside of the first element, in a direction away from the firing end of the gun, said angle being such that exhaust gas passing through said at least one aperture in the first element will exert a force on the wings causing the first element and the muzzle of the gun to move in the firing direction, and counteract the recoil action of the gun.

21. The muzzle brake of claim 18, wherein the rotational position of said second element relative to said first element is adjustable so that the degree of registration of said apertures when said second element is slidably moved relative to said first element is adjustable.

22. The muzzle brake of claim 17, wherein the first and second elements have two sets of axially spaced apertures, and wherein the two sets of axially spaced apertures comprises at least two diametrically opposed arcuately shaped slots which extend through the material of the first and second elements.

23. The muzzle brake of claim 22, wherein each of the slots extends over an angle in the order of 110 over the circumference of the first and second elements.

24. A muzzle brake in combination with a gun comprising:

an annular member mountable on a firing end of the muzzle of the gun, wherein the annular member comprises a pair of elements, the first element is mounted stationary relative to the muzzle of the gun, and the second element is slidably movable against biasing action of a means relative to said first element in a direction opposite a firing direction of the gun, said movement taking place under the influence of exhaust gas resulting from the firing of a projectile by the gun, said movement being from a first extreme position into which said biasing means forces said second element, in which position the brake is in the off position, to a second extreme position where the brake is in the fully 'on' position, in which position said exhaust gas can force the first element and the muzzle of the gun to move in the firing direction to counteract recoil action of the gun, wherein said first extreme position of the second element is defined by an annular shoulder provided in the bore of the first element at that end furthest away from the muzzle of the gun, wherein the shoulder is defined by the rim of an annular cap which fits into a mouth of the first element at the end furthest away from the muzzle of the gun.

25. The muzzle brake of claim 24, wherein the first and second elements are annular and are concentrically located relative to each other, the first element having at least one aperture being so located relative to apertures on the second element, wherein when the second element is in its said first extreme position, the apertures are completely out of register with each other and the brake is in the fully 'off' position, and when the second element is in its said second extreme position, the apertures register fully with each other and the brake is in the fully 'on' position.

26. The muzzle brake of claim 25, wherein the first and second elements have at least two apertures which are located in diametrically opposed relationship relative to one another.

27. The muzzle brake of claim 25, wherein at least one aperture of the first element is provided with a wing which extends at an angle to the outside of the first element, in a direction away from the firing end of the gun, said angle being such that exhaust gas passing through said at least one aperture in the first element will exert a force on the wings causing the first element and the muzzle of the gun to move in the firing direction, and counteract the recoil action of the gun.

28. The muzzle brake of claim 25, wherein the rotational position of said second element relative to said first element is adjustable so that the degree of registration of said apertures when said second element is slidably moved relative to said first element is adjustable.

29. The muzzle brake of claim 24, wherein the first and second elements have two sets of axially spaced apertures, and wherein the two sets of axially spaced apertures comprises at least two diametrically opposed arcuately shaped slots which extend through the material of the first and second elements.

30. The muzzle brake of claim 29 wherein each of the slots extends over an angle in the order of 110 over the circumference of the first and second elements.

31. A muzzle brake in combination with a gun comprising:

an annular member mountable on a firing end of the muzzle of the gun, wherein the annular member comprises a pair of elements, the first element is mounted stationary relative to the muzzle of the gun, and the second element is slidably movable against biasing action of a means relative to said first element in a direction opposite a firing direction of the gun, said movement taking place under the influence of exhaust gas resulting from the firing of a projectile by the gun, said movement being from a first extreme position into which said biasing means forces said second element, in which position the brake is in the off position, to a second extreme position where the brake is in the fully 'on' position, in which position said exhaust gas can force the first element and the muzzle of the gun to move in the firing direction to counteract recoil action of the gun, wherein said first and second elements comprise a pair of concentrically located metal sleeves, where said first element comprises the outer sleeve and said second element comprises the inner sleeve.

32. The muzzle brake of claim 31, wherein the first and second elements are annular and are concentrically located relative to each other, the first element having at least one aperture being so located relative to apertures on the second element, wherein when the second element is in its said first extreme position, the apertures are completely out of register with each other and the brake is in the fully 'off' position, and when the second element is in its said second extreme position, the apertures register fully with each other and the brake is in the fully 'on' position.

33. The muzzle brake of claim 32, wherein the first and second elements have at least two apertures which are located in diametrically opposed relationship relative to one another.

34. The muzzle brake of claim 32, wherein at least one aperture of the first element is provided with a wing which extends at an angle to the outside of the first element, in a direction away from the firing end of the gun, said angle being such that exhaust gas passing through said at least one aperture in the first element will exert a force on the wing, causing the first element and the muzzle of the gun to move in the firing direction, and counteract the recoil action of the gun.

35. The muzzle brake of claim 32, wherein the rotational position of said second element relative to said first element is adjustable so that the degree of registration of said apertures when said second element is slidably moved relative to said first element is adjustable.

36. The muzzle brake of claim 31, wherein the first and second elements have two sets of axially spaced apertures, and wherein the two sets of axially spaced apertures comprises at least two diametrically opposed arcuately shaped slots which extend through the material of the first and second elements.

37. The muzzle brake of claim 36 wherein each of the slots extends over an angle in the order of 110 over the circumference of the first and second elements.

* * * * *